US009153899B2

(12) United States Patent
Morello et al.

(10) Patent No.: US 9,153,899 B2
(45) Date of Patent: Oct. 6, 2015

(54) ELECTRICAL CONNECTOR ASSEMBLY WITH TERMINAL RETAINING SEAL

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 137 days.

(21) Appl. No.: 14/048,214

(22) Filed: Oct. 8, 2013

(65) Prior Publication Data

US 2015/0099384 A1 Apr. 9, 2015

(51) Int. Cl.
*H01R 13/52* (2006.01)
*H01R 13/426* (2006.01)
*H01R 13/432* (2006.01)

(52) U.S. Cl.
CPC ..... *H01R 13/521* (2013.01); *H01R 13/426* (2013.01); *H01R 13/432* (2013.01)

(58) Field of Classification Search
USPC ..... 439/271, 595
IPC ..... H01R 13/5219,13/5202, 13/5221, 13/4223, H01R 13/4365
See application file for complete search history.

(56) References Cited

U.S. PATENT DOCUMENTS

| | | | | |
|---|---|---|---|---|
| 4,684,187 | A * | 8/1987 | Rudy et al. | 439/600 |
| 4,711,509 | A * | 12/1987 | Cross et al. | 439/587 |
| 4,921,437 | A * | 5/1990 | Cooper et al. | 439/275 |
| 5,273,456 | A * | 12/1993 | Muzslay | 439/489 |
| 5,664,954 | A * | 9/1997 | Rea et al. | 439/125 |
| 6,786,768 | B2 * | 9/2004 | Murakami | 439/595 |
| 7,351,102 | B2 * | 4/2008 | Cykon et al. | 439/587 |
| 8,133,076 | B2 * | 3/2012 | Nakamura | 439/595 |

* cited by examiner

*Primary Examiner* — Hien Vu
(74) *Attorney, Agent, or Firm* — Robert J. Myers

(57) ABSTRACT

An electrical connector assembly is provided. The assembly includes a terminal, a housing, and a seal. The seal is configured to create a moisture barrier between the housing and a mating connector. The seal defines a retainer portion that cooperates with the housing to retain the terminal to the housing.

3 Claims, 2 Drawing Sheets

ELECTRICAL CONNECTOR ASSEMBLY WITH TERMINAL RETAINING SEAL

TECHNICAL FIELD OF INVENTION

This disclosure generally relates to an electrical connector assembly, and more particularly relates to a sealed electrical connector assembly.

BACKGROUND OF INVENTION

Electrical connector assemblies are known to include redundant (e.g. primary and secondary) terminal locking features to ensure that the terminals of the connector assembly stay retained within the housing of the connector assembly. The primary locking feature typically consists of a flexible member on either the terminal or the housing that locks into a cavity when the terminal is inserted into the housing. The secondary locking feature typically consists of a plastic clip that engages with the housing and terminal to retain the terminal within the housing. The plastic clip is sometimes referred to as a terminal position assurance (TPA) or an independent secondary lock (ISL). The plastic clip may be a discrete component or be a molded feature that is formed and hinged to the housing. A drawback of these known secondary locking designs is the cost associated with a discrete clip that is handled as a separate part, or a hinged clip that requires complex tooling.

SUMMARY OF THE INVENTION

In accordance with one embodiment an electrical connector assembly is provided. The assembly includes a terminal configured to make an electrical contact with a mating contact of a mating connector. The assembly further includes a housing configured to hold the terminal. The assembly further includes a seal configured to create a moisture barrier between the housing and the mating connector. The seal defines a retainer portion that cooperates with the housing to retain the terminal to the housing.

BRIEF DESCRIPTION OF DRAWINGS

The present invention will now be described, by way of example with reference to the accompanying drawings, in which.

DETAILED DESCRIPTION

Figure 1:
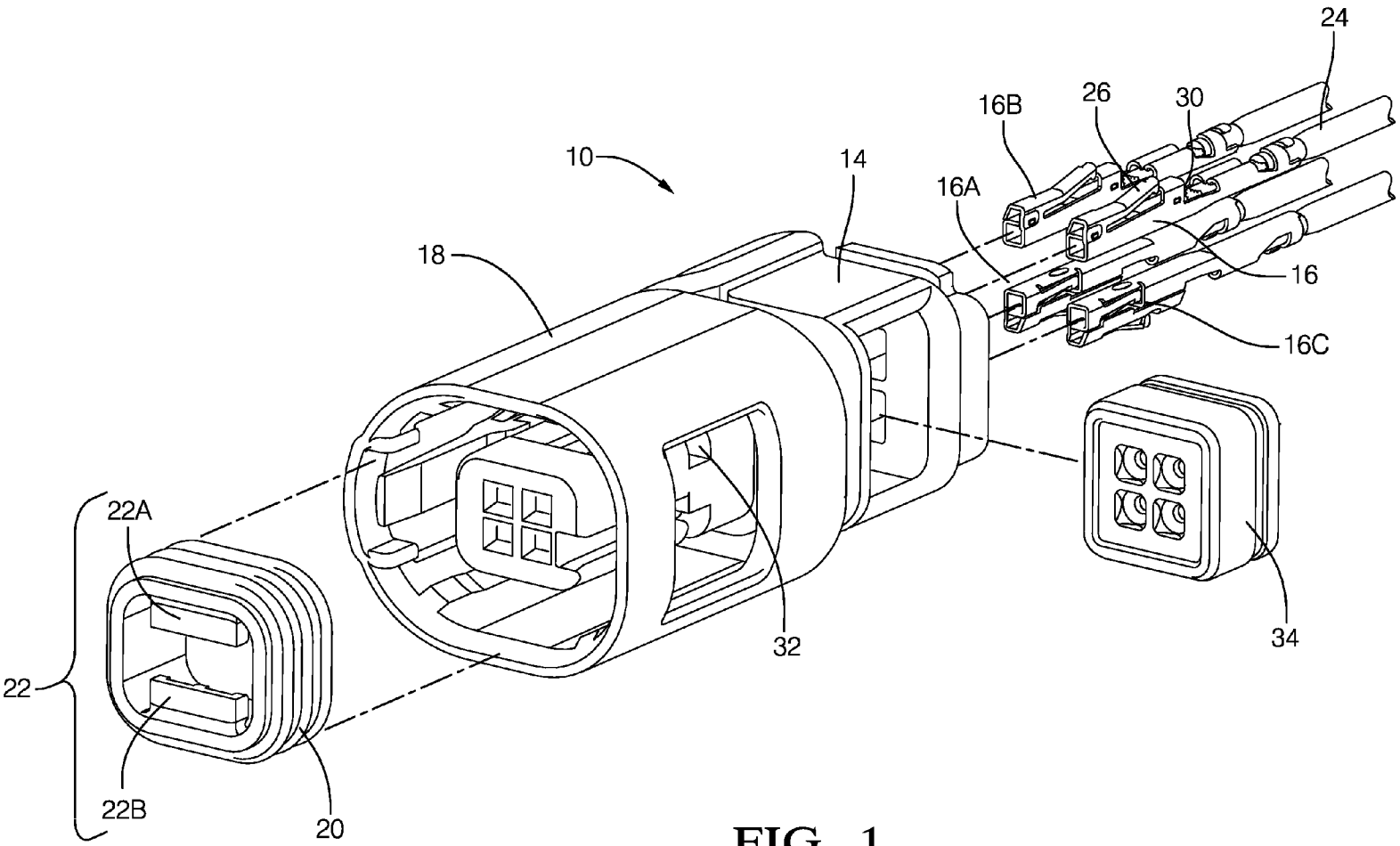
FIG. 1 is an exploded view of an electrical connector assembly in accordance with one embodiment.
Figure 2:
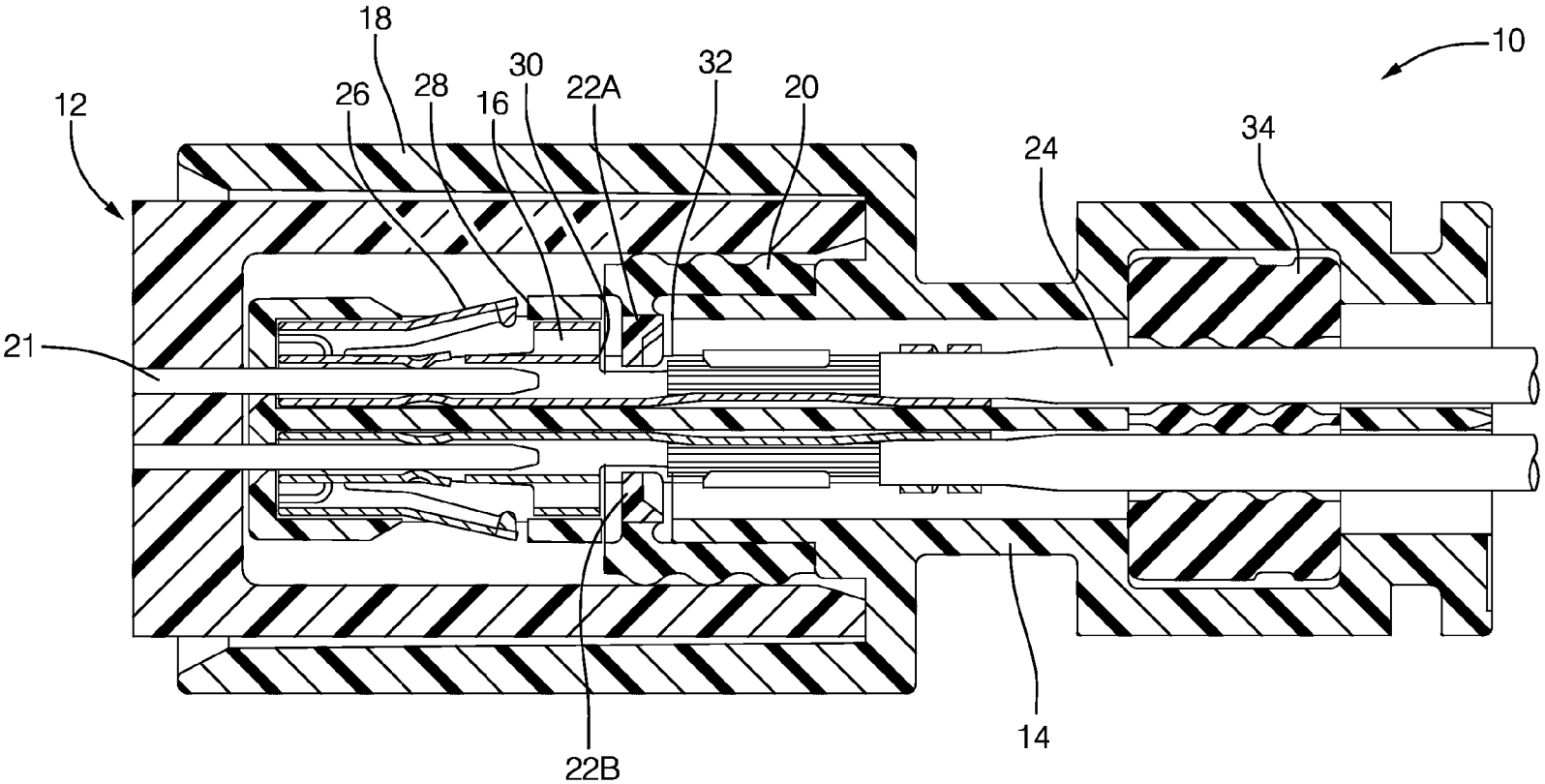
FIG. 2 is a sectional view of the electrical connector assembly engaged with a mating connector in accordance with one embodiment.

FIGS. 1 and 2 illustrate a non-limiting example of an electrical connector assembly 10 configured to engage with a mating connector 12 (FIG. 2). The assembly 10 includes a housing 14. The housing 14 is configured to hold a terminal 16 of the assembly 10, and in the example shown, to also hold terminals 16A, 16B, and 16C that are similar in design and function to the terminal 16. The housing 14 defines a shroud portion 18 that protects a seal 20 of the assembly 10 when the assembly 10 is not engaged with the mating connector 12. The housing 14 is preferably made of plastic.

The terminal 16 of the assembly 10 is configured to make an electrical contact with a mating contact 21 (FIG. 2) of the mating connector 12. The electrical contact is made when the assembly 10 is engaged with the mating connector 12. The terminal 16 is also configured to be crimped to a lead wire 24. The terminal 16 defines a tang portion 26 that cooperates with the housing 14 to retain the terminal 16 to the housing 14. After the terminal 16 is inserted into the housing 14, the tang portion 26 engages an edge 28 (FIG. 2) of the housing 14 to retain the terminal 16. The engagement of the tang portion 26 with the edge 28 provides a first means for retaining the terminal 16 to the housing 14. This first means may be referred to as a primary terminal locking feature.

The seal 20 of the assembly 10 is configured to create a moisture barrier between the housing 14 and the mating connector 12 when the assembly 10 engages the mating connector 12. The seal 20 defines a retainer portion 22 that in this example includes an upper portion 22A and lower portion 22B. The retainer portion 22 cooperates with the housing 14 to retain the terminal 16 to the housing 14. The upper portion 22A engages a backside 30 of the terminal 16 and a surface 32 of the housing 14 to retain the terminal 16. This engagement provides a second means for retaining the terminal 16. This second means may be referred to as a redundant terminal locking feature or a secondary terminal locking feature. It is noted here that the secondary terminal locking feature of the assembly 10 is not comparable to a separate plastic clip that is assembled to the assembly 10, or a hinged clip that is moved into position when making the assembly 10, as is the case for such features shown by the prior art. The retainer portion 22 of the seal 20 is preferably made of a relatively rigid material such as Polybutylene Terephthalate Polyester (PBT) or nylon, and the remaining portion of the seal 22 is preferably made of a relatively flexible material such as silicone. The seal 20 may be fabricated utilizing known two-shot injection molding methods where two distinct materials (e.g. relatively rigid and relatively flexible) are injected to form different regions of an otherwise unitary part. By way of example and not limitation, a suitable choice for the relatively rigid material is Polybutylene Terephthalate Polyester (PBT), and the relatively soft material is synthetic compound silicone as these materials will bond together during the two-shot type injection molding.

The assembly 10 may include a wire holder 34 configured to create a moisture barrier between the lead wire 24 and the housing 14 when the terminal 16 is inserted into the housing 14. The wire holder 34 is preferably made of a relatively flexible material such as silicone.

Accordingly, an electrical connector assembly with a terminal retaining seal is provided. The electrical connector assembly 10 provides cost savings when compared to the known art by eliminating the need for a discrete plastic clip or a hinged plastic clip in order to provide a secondary terminal locking feature for retaining the terminal 16 within the housing 14 before or after any action of engaging or disengaging the assembly 10 with the mating connector 12.

While this invention has been described in terms of the preferred embodiments thereof, it is not intended to be so limited, but rather only to the extent set forth in the claims that follow.

We claim:

1. An electrical connector assembly configured to engage with a mating connector, said assembly comprising:

a terminal configured to make an electrical contact with a mating contact of the mating connector;

a housing configured to hold the terminal; and a seal configured to create a moisture barrier between the housing and the mating connector when the assembly engages the mating connector;

wherein the seal defines a retainer portion having an upper projecting portion and a lower projecting portion extended into the seal that cooperate with an inner portion of the housing to engage with the terminal for retaining the terminal to the housing, wherein the retainer portion is made of a different material than the remaining portion of the seal; and wherein the seal is a singular element.

2. The electrical connector assembly of claim 1, wherein the terminal defines a tang portion that cooperates with the housing to retain the terminal to the housing.

3. The electrical connector assembly of claim 1, wherein the housing defines a shroud portion that protects the seal when the assembly is not engaged with the mating connector.

* * * * *